US007486009B2

(12) United States Patent
Ricaud et al.

(10) Patent No.: US 7,486,009 B2
(45) Date of Patent: Feb. 3, 2009

(54) ELECTRON GUN FOR CATHODE-RAY TUBE WITH IMPROVED BEAM SHAPING REGION

(75) Inventors: Jean-Luc Ricaud, St. Ismier (FR); Christian Galmiche, Auxonne (FR); Philippe Arnaud, Bellefond (FR)

(73) Assignee: Thomson Licensing, Boulogne Billancourt (FR)

( * ) Notice: Subject to any disclaimer, the term of this patent is extended or adjusted under 35 U.S.C. 154(b) by 437 days.

(21) Appl. No.: 11/084,658

(22) Filed: Mar. 18, 2005

(65) Prior Publication Data

US 2005/0218776 A1 Oct. 6, 2005

(30) Foreign Application Priority Data

Mar. 30, 2004 (FR) ..... 04 50617

(51) Int. Cl.
*H01J 29/50* (2006.01)

(52) U.S. Cl. ..... 313/414; 313/409

(58) Field of Classification Search ..... 313/414, 313/409

See application file for complete search history.

(56) References Cited

U.S. PATENT DOCUMENTS 4,492,894 A 1/1985 Reule et al. ..... 313/414
4,952,186 A * 8/1990 Maninger et al. ..... 445/36
5,081,393 A 1/1992 Kinami ..... 313/412
5,944,571 A 8/1999 van Raalte et al. ..... 445/3
6,476,546 B1 * 11/2002 Bae ..... 313/447
6,919,674 B2 * 7/2005 Jeong ..... 313/412

FOREIGN PATENT DOCUMENTS

EP 0 425 205 A2 10/1990
FR 2 753 566 9/1996

OTHER PUBLICATIONS http://www.matweb.com/search/DataSheet.aspx?MatID=14699; materials data sheet.*
http://www.phynicx.com/site/soft_magnetic_alloys.php; materials data sheet.*
European Search Report.

* cited by examiner

*Primary Examiner*—Peter Macchiarolo
(74) *Attorney, Agent, or Firm*—Joseph J. Laks; Harvey D. Fried; Patricia Verlangieri

(57) ABSTRACT

An electrode gun for a cathode-ray tube, including at least a first electrode and a second electrode for shaping and focusing the electron beam emitted by a cathode is described. These electrodes are made of a non-oxidizing alloy whose coefficient of expansion between 20° C. and 300° C. lies between $4\times10^{-6}$/° C. and $13\times10^{-6}$/° C.

5 Claims, 5 Drawing Sheets

ELECTRON GUN FOR CATHODE-RAY TUBE WITH IMPROVED BEAM SHAPING REGION

FIELD OF THE INVENTION

The invention relates to an electron gun and, in particular, an electron gun which is more resistant to the emission problem caused by oxidation of the electrodes G1 and/or G2 when it is being sealed into the tube (mount-sealing) and more resistant to the problem of thermomechanically induced remanent deformation caused by heating in the course of the radiofrequency induction (RF heating) carried out when pumping the cathode-ray tube.

BACKGROUND OF THE INVENTION

The problem is that the characteristics of certain electrodes may become modified during the manufacture of a cathode-ray tube, and may consequently modify certain characteristics of the tube.

When the gun is being sealed to the tube, heating by flames or the like melts the glass of the tube neck and the glass of the gun base in order to weld them together in a vacuum-tight fashion. Owing to this heating in the atmosphere, the parts of the gun close to the base heat up and therefore tend to become oxidized at the surface, especially in the case of the electrodes G1 and G2 (see FIG. 1). These electrodes, however, are subsequently bombarded by the electron beam of the gun during activation of the cathodes and during the emission measurements, if these are performed without scanning the screen, which causes dissociation of the surface oxides into metals and oxygen gas. Moreover, oxygen is a poison for the cathodes since it degrades their electron emission. One symptom is that the emission starts up again poorly after the cathode-ray tube has been stored for a few days or weeks.

Later, when pumping the cathode-ray tube, radiofrequency induction heating of the gun is carried out by means of an electromagnetic self-inductance with a view to degassing the gun. In this context, the metal parts of the gun are heated and therefore expand, respectively as a function of their temperature and the coefficient of thermal expansion of their material. Mechanical stresses are created because the expansions are not balanced between the parts, which are rigidly connected to two sintered glass bars VF1 and VF2 constituting the framework of the gun. The hottest parts of the gun are in this case the electrodes G2 (heated to a temperature of about 750° C.), G3 (heated to a temperature of about 790° C.) and G1 (heated to a temperature of about 680° C.). The drawback of the mechanical stresses is a remanent deformation of certain parts of the gun, and in the worst case cracking or fracture of the two sintered glass bars VF1 and VF2 (especially if they experience mechanical stresses when the gun is being cooled after the end of the RF heating).

During operation of the cathode-ray tube at startup of the cathode-ray tube, expansions are subsequently caused by the heating filaments and increase up to the steady-state regime corresponding to the time at which the filaments and the cathodes have reached their rated temperatures (generally with 6.3 V across the terminals of the filaments). The most strongly. heated metal parts of the gun are the ones closest to the heating filaments and the cathodes, particularly the cathode supports, the electrode G1 and the electrode G2. In this context, the drawback of the mechanical stresses is an imbalance of the picture colors (color temperature change: CTC) due to differences between the red, green and blue beam currents, the CTC being caused by the problem of non-remanent deformation at startup of the cathode-ray tube.

Furthermore, the cost of the gun depends in particular on the cost of the materials constituting the parts of the gun. Alloys having low coefficients of thermal expansion, such as the metal alloys of the family FeNi (that is to say in which Fe and Ni make up more than 95% of the mass) and the metal alloys of the family FeNiCo (that is to say in which Fe, Ni and Co make up more than 95% of the mass) are more expensive than stainless steels.

Electron guns in which the electrodes are made of FeNi, and which for example have the characteristics summarised in the table below, are known:

| | | | Tube startup, 6.3 V being applied | | | RF induction heating of the gun | | |
|---|---|---|---|---|---|---|---|---|
| | Selected | Expansible width between the glass bars | T° stabilized | Coefficient of expansion of the material | Expansion at startup (μm) | T° stabilized | Coeff. of expansion of the material | RF expansion (μm) |
| | material | mm | ° C. | $10^{-6}$/° C. | μm | ° C. | $10^{-6}$/° C. | μm |
| G4 et seq. | FeNi42 | 15 | 70 | 5.3 | 6 | 600 | 7.6 | 68 |
| G3 | FeNi48 | 15 | 80 | 8.7 | 10 | 790 | 11.4 | 135 |
| G2 | FeNi42 | 15 | 120 | 5.3 | 10 | 750 | 8.6 | 97 |
| G1 | FeNi42 | 15 | 180 | 5.3 | 14 | 680 | 8.0 | 82 |
| cathode supports | FeNi42 | 15 | 300 | 6.0 | 27 | 550 | 7.0 | 58 |

FIG. 2 represents a graph indicating the expansions of the electrodes G1 to G4 and of the cathode supports in such an electron gun during RF induction heating and at startup of the gun. It can be seen that such an electron gun exhibits expansions which are acceptable and, in particular, approximately uniform for the various electrodes in RF. The electrodes G1 and G2, however, are not resistant to the oxidation and present a strong risk of having poor electron emission.

Another type of electron gun, such as the Toshiba and Matsushita guns in particular, uses the material "Kovar" (FeNiCo alloy) for G1 and G2. This alloy has a low coefficient of thermal expansion but cannot withstand the oxidation as much a stainless steel, and it is more expensive.

It will be understood that there is no known electron gun in which the electrodes and the electrode supports are made of a material such that:

the electron gun is resistant to the emission problem caused by oxidation of the electrodes G1 and/or G2 when it is being sealed into the tube (mount-sealing), there are no expansion problems detrimental to the working life of the gun, the CTC (color temperature change) is stable and acceptable.

A conventional solution to the problem of oxidation is to use conventional stainless steel from the family of austenitic steels, such as the Type 305 steel whose UNS designation is S30500, for the electrodes G1 and G2. In this case, however, the electron gun will not be resistant to the problem of thermomechanically induced remanent deformation caused by heating in the course of the radiofrequency induction (RF heating) for pumping. Furthermore, the gun then has a mediocre "CTC" (color temperature change).

When wishing to make the gun more resistant to the problem of thermomechanically induced remanent deformation caused by heating in the course of the radiofrequency induction (RF heating) for pumping, the known solution is to use alloys having lower coefficients of thermal expansion for the electrodes G1, G2 and G3, and more specifically metal alloys whose coefficient of expansion between 20° C. and 300° C. lies between $3\times10^{-6}$/° C. and $7\times10^{-6}$/° C.

These metal alloys, however, such as those of the family FeNi (that is to say in which Fe and Ni make up more than 95% of the mass) and of the family FeNiCo (that is to say in which Fe, Ni and Co make up more than 95% of the mass) are more expensive than stainless steels.

When wishing to provide the gun with an acceptable "CTC" (color temperature change), for example as described in U.S. Pat. No. 4,492,894, an electron gun may be provided in which the materials of the successive electrodes of the gun are selected so as to balance the expansions of these electrodes in the steady-state regime corresponding to the time at which the filaments and the cathodes have reached their rated temperatures (generally with 6.3 V across the terminals of the filaments). The hottest electrodes will therefore have the lowest coefficients of expansion.

Then, however, the electrode G3 will have a higher coefficient of thermal expansion than G2 even though G3 is already hotter then G2, and the electrode G2 will have a higher coefficient of thermal expansion then G1 even though G2 is already hotter then G1. The electron gun will not therefore be resistant to the problem of thermomechanically induced remanent deformation caused by heating in the course of the radiofrequency induction (RF heating) for pumping.

U.S. Pat. No. 4,468,588 addresses the CTC problem. This patent describes a solution in which the cathode supports minimize the deformations of the electrode G1 with respect to the cathodes. This document, however, does not resolve the emission problem caused by oxidation of the electrodes G1 and/or G2 when it is being sealed into the tube (mount-sealing), nor the problem of making the gun more resistant to the thermomechanically induced remanent deformations caused by heating in the course of the radiofrequency induction (RF heating) carried out when pumping the cathode-ray tube.

SUMMARY OF THE INVENTION

The invention therefore relates to an electron gun including at least one emissive cathode supported by electrode supports, a first electrode and a second electrode for control and shaping of the electron beam emitted by the cathode, a third electrode either for focusing the electron beam, if the gun has four electrodes, or for pre-focusing if the gun has more than four electrodes, and a fourth electrode for accelerating the electron beam.

The first and second electrodes are made of a non-oxidizing alloy whose coefficient of expansion between 20° C. and 300° C. lies between $4\times10^{-6}$/° C. and $13\times10^{-6}$/° C. The third electrode may be made of FeNi, and in particular FeNi48, whose coefficient of expansion differs little from that of the first and second electrodes.

Preferably, however, the third electrode is made of a non-oxidizing alloy whose coefficient of expansion between 20° C. and 300° C. lies between $4\times10^{-6}$/° C. and $13\times10^{-6}$/° C.

Also, the cathode supports are made of a non-oxidizing alloy whose coefficient of expansion between 20° C. and 300° C. lies between $4\times10^{-6}$/° C. and $13\times10^{-6}$/° C.

The fourth electrode (G4) may also be made of a stainless steel, either from the common family of austenitic steels or from the family of ferritic steels, such as the subfamily referred to as Type 430 whose UNS designation is S43000.

The non-oxidizing alloy whose coefficient of expansion between 20° C. and 300° C. lies between $4\times10^{-6}$/° C. and $13\times10^{-6}$/° C. is preferably a steel from the family of ferritic steels, such as the subfamily referred to as Type 430 whose UNS designation is S43000.

The third electrode G3 also preferably includes a piece of FeNi material which can delimit the electromagnetic field of the deflector.

BRIEF DESCRIPTION OF THE DRAWINGS

The various objects and characteristics of the invention will become more readily apparent from the following description and the appended figures, in which.

DETAILED DESCRIPTION OF THE PRESENT INVENTION

A conventional television tube has a substantially flat rectangular front panel or screen. The screen is provided on its inner face with a mosaic of phosphor spots or pixels which, when stimulated by an electron beam, emit light that may be blue, green or red depending on which phosphor is stimulated.

Figure 1:
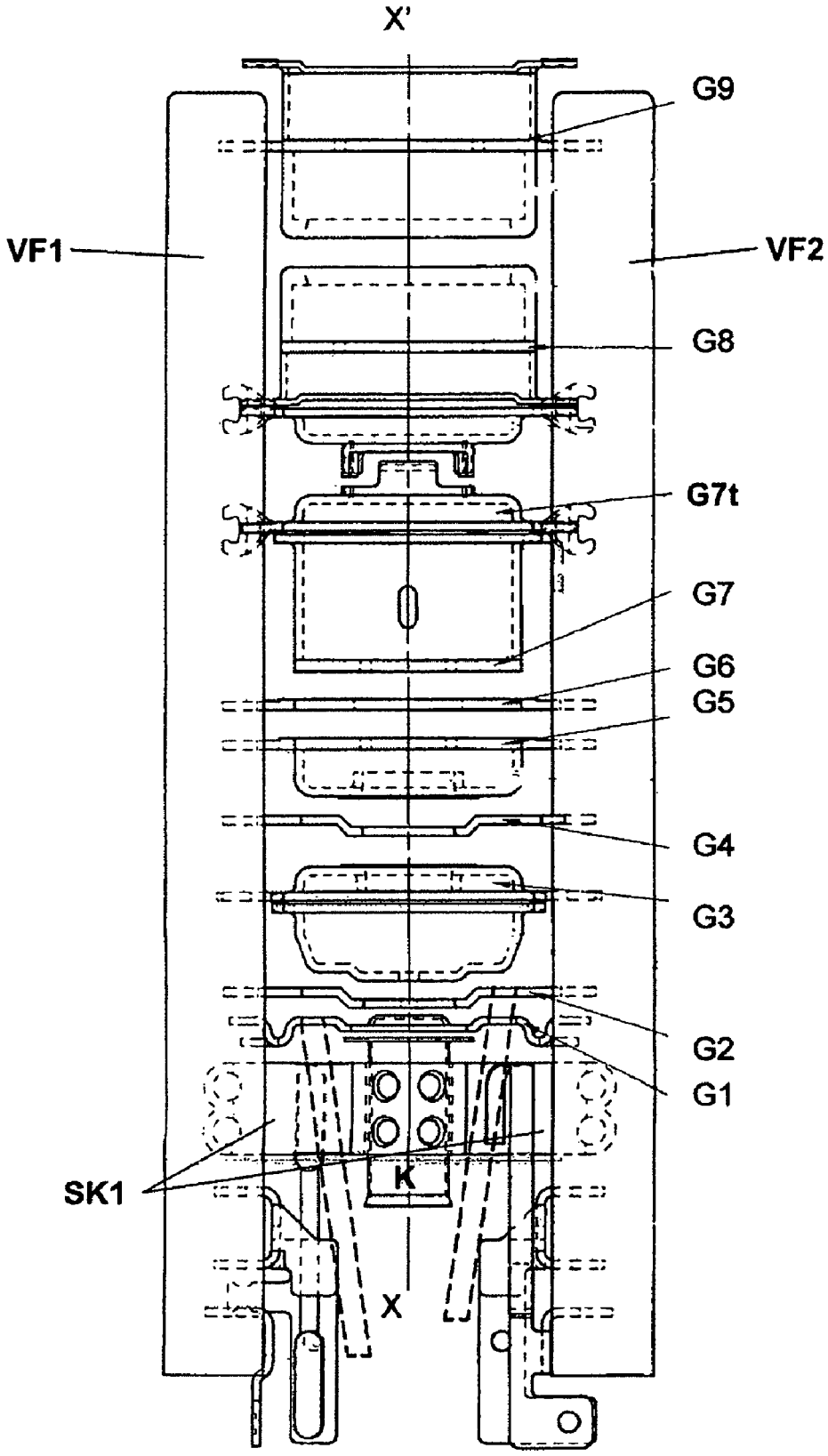
FIG. 1 represents an electron gun to which the invention applies.
Figure 2:
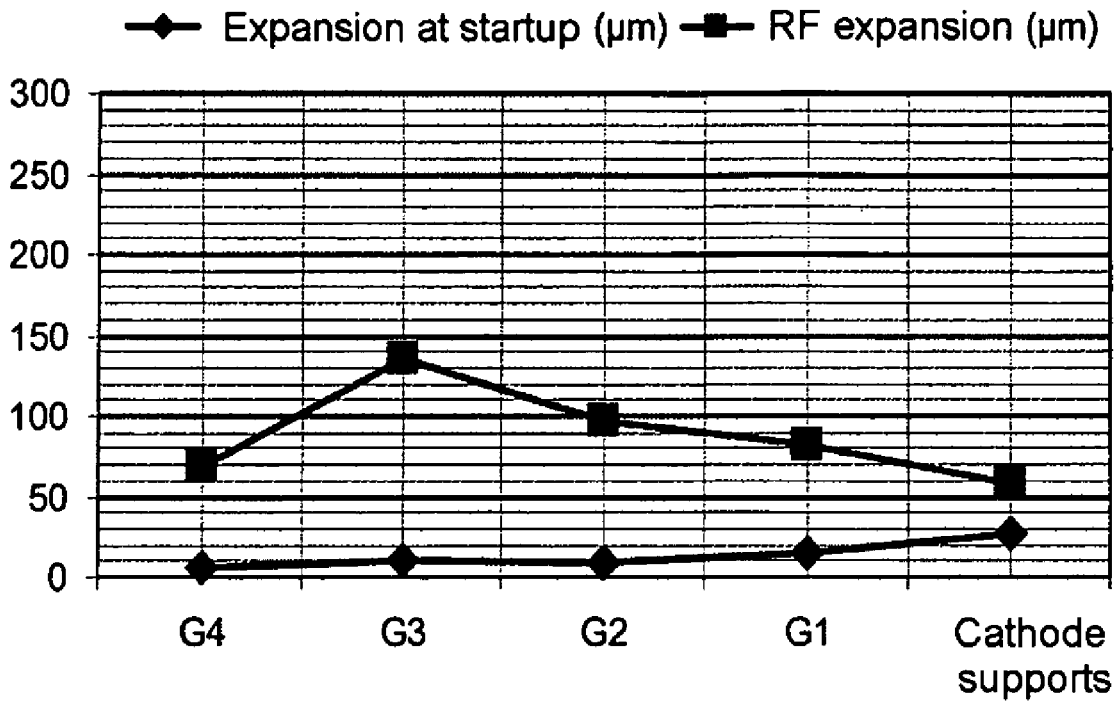
FIG. 2 represents a graph relating to an example of an electron gun known in the prior art and described above.

An electron gun as represented in FIG. 1, sealed in the envelope of the tube, is directed at the center of the screen and makes it possible to emit the electron beam towards the various points on the screen through a perforated mask (or shadow mask). The electron gun allows the electron beam to be focussed on the inner face of the screen carrying the phosphors.

The electron gun in FIG. 1 therefore has a cathode K emitting electrons by thermo-emission. This cathode is held by a support SK1 which is fixed on one side to the glass bar VF1 and, on the other side, to the glass bar VF2. In the case of a color screen, the electron gun has three emitting cathodes, the other two cathodes being held by two supports similar to the support SK1.

An electrode G1 in conjunction with the electrode G2 initiates the formation of an electron beam along the axis XX' from the electrons emitted by the cathode. The electrode G2 focuses the beam thus formed towards a focusing point, referred to as a "crossover". The size of this focusing point is as small as possible. For example, the electrode G1 is at a variable potential of between the reference earth and 150 volts. The electrode G2 is at a fixed potential of between 300 volts and 1200 volts.

An electrode G3, to which a potential of between 6000 and 9000 volts is applied according to this example, contributes to the acceleration of the electrons.

An electrode G4 to which a potential substantially equivalent to that of the electrode G2 is applied constitutes, together with the electrode G3 and the part of the electrode G5 facing G4, a pre-focusing electron lens for the electron beam.

Electrodes G5, G6 and G7 constitute quadrupole lenses and will induce a quadrupole effect on the beam, so as to exert a force compressing the electron beam in the vertical plane and a distortion in the horizontal plane.

A device G7-G8 produces a quadrupole effect which tends to exert a compression force on the electron beam over the horizontal plane and a distortion over the vertical plane.

An electrode G9 is the electrode which, together with G8, constitutes the main output lens.

All the elements of the gun as described above must be aligned as rigorously as possible along the axis XX' and have positions along this axis which remain fixed when the gun is heated. This is why these various elements are held between two sintered glass bars VF1 and VF2, which have the advantage of not deforming under the effect of heat.

The invention relates to an electron gun structure characterized by the use of particular metal alloys for certain parts. The object of the invention is to obtain an electron gun in which the parts (electrodes and cathode supports) connected to the sintered glass bars VF1 and VF2 (which constitute holding parts for the parts of the gun) expand substantially in the same way as the parts next to them in order to avoid creating stresses in the glass bars, specifically during the RF induction heating and at startup of the gun of the tube, in which the electrodes, especially the electrodes G1 and G2, do not have a tendency to become oxidized, and in which the CTC (color temperature change) remains acceptable.

The invention therefore proposes that, for the electrodes G1 and G2, a non-oxidizing alloy should be used whose coefficient of expansion between 20° C. and 300° C. lies between $4\times10^{-6}$/° C. and $13\times10^{-6}$/° C. (for example between $7\times10^{-6}$/° C. and $13\times10^{-6}$/° C.). This alloy is preferably a stainless steel from the family of ferritic steels, preferably from the subfamily referred to as Type 430 whose designation in the UNS standard is S43000, and which will be referred to as Inox 430 steel in the rest of the description. This Inox 430 steel is described in the document Atlas Stainless Steel Grades from the AISI (American Iron and Steel Institute).

Such a metal presents the advantages of having a low coefficient of thermal expansion, of being inexpensive and of not oxidizing. This material was chosen for the electrodes G1 and G2 because these electrodes are the ones most liable to be both oxidized and bombarded by the electron beam. The table below summarises the characteristics of such an electron gun.

The electrode G3 is, for example, made of FeNi48.

Figure 3A:
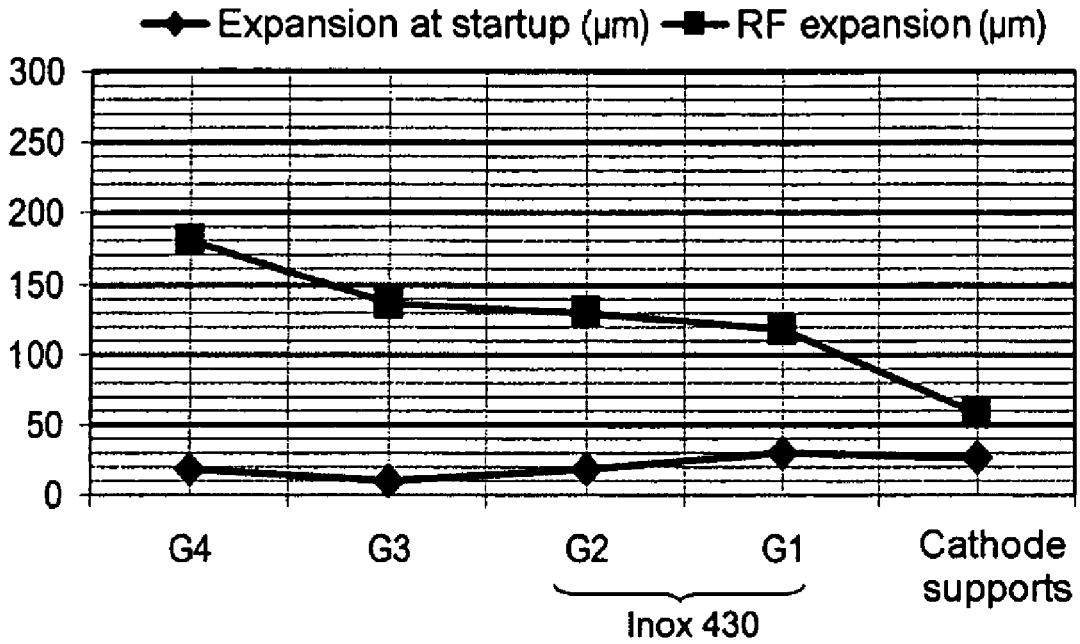
FIGS. 3*a* to 3*d* represent graphs relating to electron. guns according to the invention.

FIG. 3*a* furthermore illustrates the expansions of the electrodes G1 to G4 and of the cathode supports, such as SK1, by diagrams. As can be seen, the expansions of these various elements are substantially equivalent in RF induction heating and at startup of the gun. There is little difference between the expansion of an electrode and the neighboring elements (electrodes or cathode supports). The expansions of the elements connected to the sintered glass bars VF1 and VF2 may therefore be regarded as substantially homogeneous. There is therefore little remanent deformation of the metal parts and little risk of creating stresses in the glass bars VF1 and VF2.

| | | | Tube startup, 6.3 V being applied | | | RF induction heating of the gun | | |
|---|---|---|---|---|---|---|---|---|
| | Selected | Expansible width between the glass bars | T° stabilized | Coefficient of expansion of the material | Expansion at startup (μm) Unit | T° stabilized | Coeff. of expansion of the material | RF expansion (μm) |
| | material | mm | ° C. | $10^{-6}$/° C. | μm | ° C. | $10^{-6}$/° C. | μm |
| G4 et seq. | Inox 305 | 15 | 70 | 17 | 18 | 600 | 20 | 180 |
| G3 | FeNi48 | 15 | 80 | 8.7 | 10 | 790 | 11.4 | 135 |
| G2 | Inox 430 | 15 | 120 | 10 | 18 | 750 | 11.5 | 129 |
| G1 | Inox 430 | 15 | 180 | 11 | 30 | 680 | 11.5 | 117 |
| cathode supports | FeNi42 | 15 | 300 | 6 | 27 | 550 | 7 | 58 |

Such an electron gun is thus advantageous because of the homogeneous expansions of the electrodes G1 to G4 and of the electrode supports, the low risk of oxidizing the electrodes G1 and G2, its acceptable CTC (color temperature change) and for economic reasons.

The electrode G3 is liable to be bombarded by the electron beam, but is exposed very little to oxidation during manufacture of the tube because it is not heated greatly during the sealing.

Figure 4:
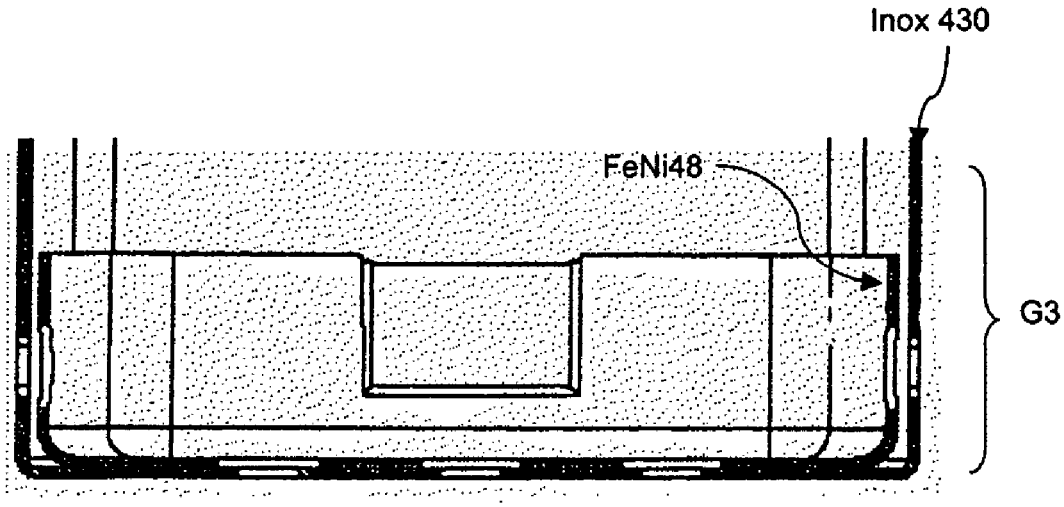
FIG. 4 represents an example of an electrode G3 made of Inox 430 steel, provided with a piece of FeNi48 magnetic material.

According to an alternative embodiment, however, the part(s) of G3 which are connected to the 2 sintered glass bars VF1 and VF2 may be made of a non-oxidizing alloy whose coefficient of expansion between 20° C. and 300° C. lies between $4\times10^{-6}$/° C. and $13\times10^{-6}$/° C. (for example between $7\times10^{-6}$/° C. and $13\times10^{-6}$/° C.) It may, for example, be a non-oxidizing metal alloy of the family of steels such as Inox 430 steel. The third electrode G3 also includes a piece of a material which can delimit the electromagnetic field of the deflector, for example an "insert" piece of FeNi48. FIG. 4 represents an exemplary embodiment of such an electrode G3 made of Inox 430 steel provided with a piece of FeNi48.

The table below illustrates the characteristics of an electron gun in which the electrodes G1 to G3 are made of Inox 430 steel.

| | Selected material | Expansible width between the glass bars mm | Tube startup, 6.3 V being applied: T° stabilized ° C. | Coefficient of expansion of the material $10^{-6}$/° C. | Expansion at startup Unit µm | RF induction heating of the gun: T° stabilized ° C. | Coeff. of expansion of the material $10^{-6}$/° C. | RF expansion (µm) µm |
|---|---|---|---|---|---|---|---|---|
| G4 et seq. | Inox 305 | 15 | 70 | 17 | 13 | 600 | 20 | 174 |
| G3 | Inox 430 | 15 | 80 | 10.5 | 9 | 790 | 11.5 | 133 |
| G2 | Inox 430 | 15 | 120 | 10.7 | 16 | 750 | 11.5 | 126 |
| G1 | Inox 430 | 15 | 180 | 11.0 | 26 | 680 | 11.5 | 114 |
| cathode supports | FeNi42 | 15 | 300 | 6 | 25 | 550 | 7 | 56 |

Figure 3B:
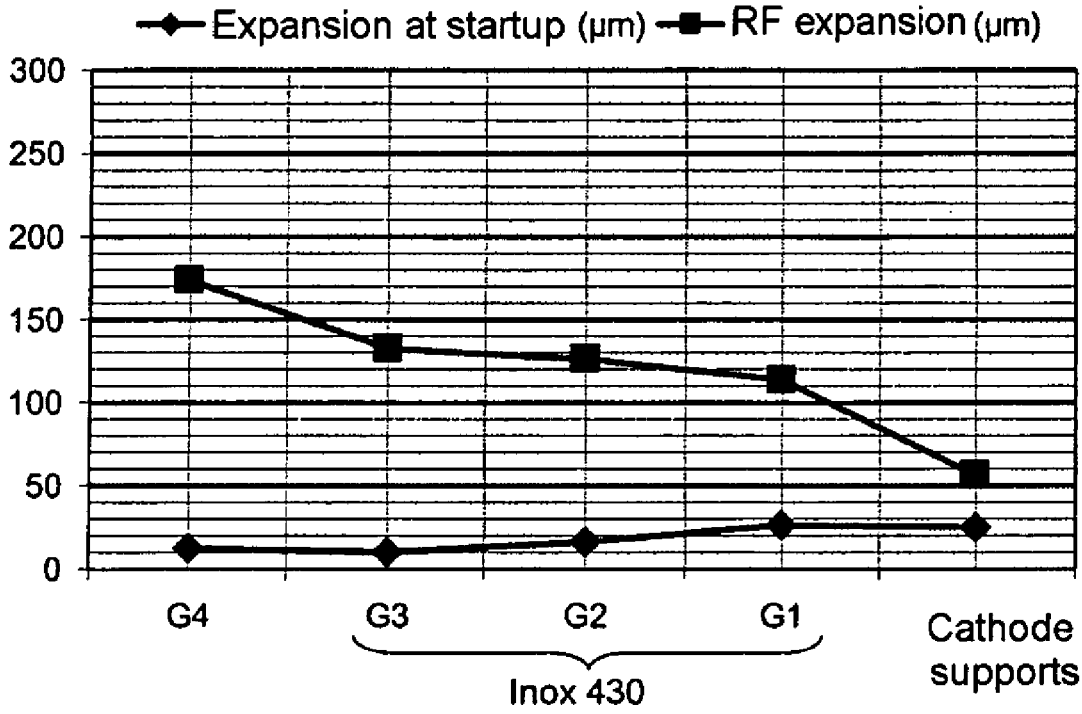

The diagrams in FIG. 3*b* illustrate the expansions of the electrodes G1 to G4 and of the cathode supports in this alternative embodiment. The expansions of these elements appear homogeneous.

According to another alternative embodiment of the invention, the electrodes G1 and G2 are made of a material as defined above (Inox 430 steel) and an alloy with a low coefficient of thermal expansion is used for the cathode supports. This alloy need not be resistant to oxidation since the supports are never bombarded by the electron beam, but it is preferable to use a stainless steel from the family of ferritic steels, namely the family referred to as Type 430 whose US designation is S43000. The table below gives the characteristics of such an electron gun:

| | Selected material | Expansible width between the glass bars mm | Tube startup, 6.3 V being applied: T° stabilized ° C. | Coefficient of expansion of the material $10^{-6}$/° C. | Expansion at startup (µm) Unit µm | RF induction heating of the gun: T° stabilized ° C. | Coeff. of expansion of the material $10^{-6}$/° C. | RF expansion (µm) µm |
|---|---|---|---|---|---|---|---|---|
| G4 et seq. | Inox 305 | 15 | 70 | 17 | 13 | 600 | 20 | 174 |
| G3 | Feni48 | 15 | 80 | 8.7 | 8 | 790 | 11.4 | 132 |
| G2 | Inox 430 | 15 | 120 | 10 | 15 | 750 | 11.5 | 126 |
| G1 | Inox 430 | 15 | 180 | 11 | 26 | 680 | 11.5 | 114 |
| cathode supports | Inox 430 | 15 | 300 | 11 | 46 | 550 | 11 | 89 |

Figure 3C:
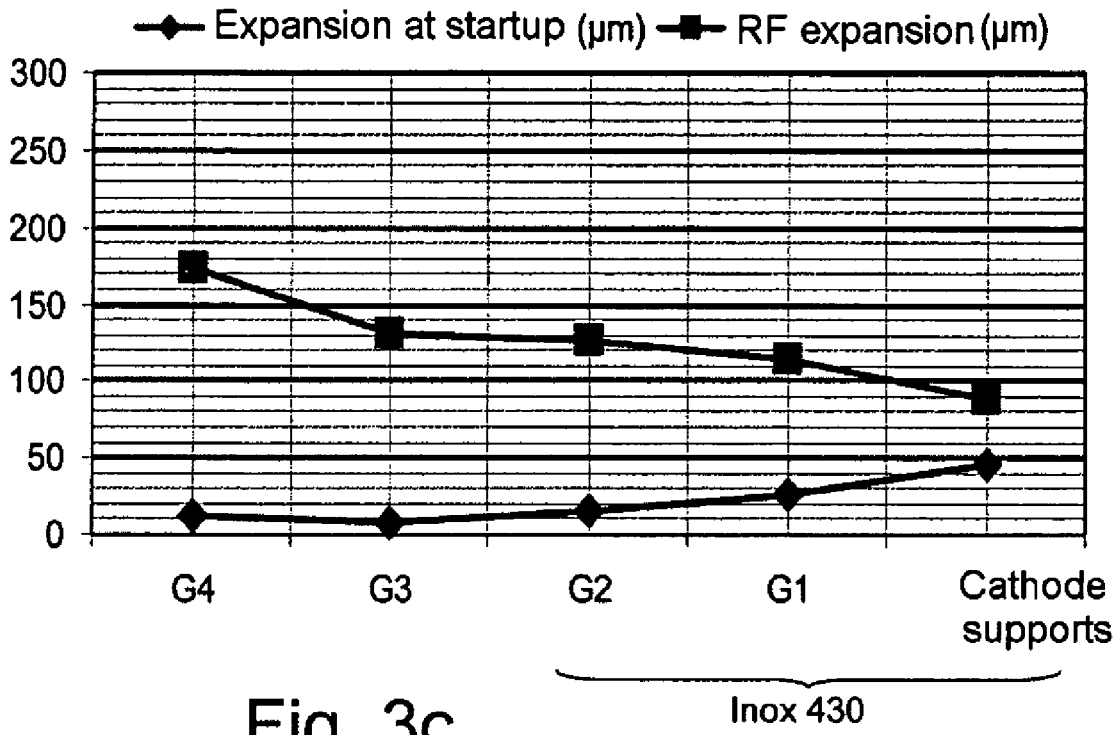
Figure 3D:
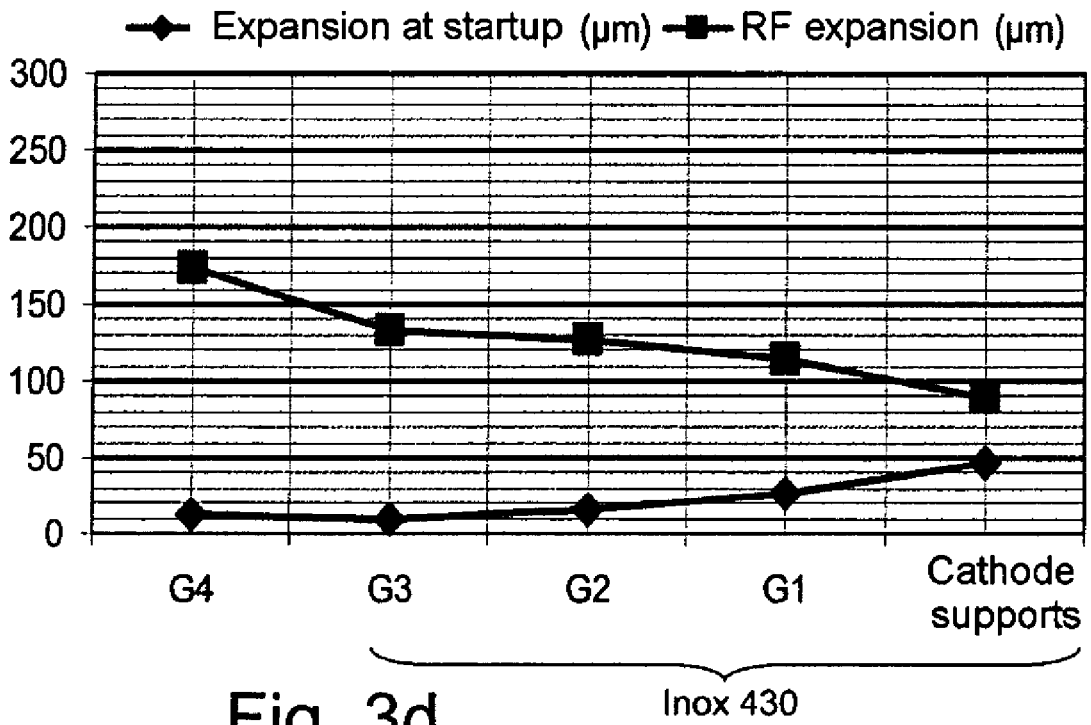

FIG. 3*c* represents the expansions of the electrodes G1 to G4 and of the cathode supports in this variant. These expansions appear homogeneous for the various elements. As before, there is a good resistance to oxidation and an acceptable CTC (sufficient flexibility being imparted to the cathode supports such as SK1).

According to another alternative embodiment, the electrodes G1 to G3 and the cathode supports are made of Inox 430 steel.

In this electron gun, the following are therefore used. A stainless steel for G2 and G1 from the family of ferritic steels, preferably from the subfamily referred to as Type 430 whose UNS designation is S43000, as described in the document Atlas Stainless Steel Grades from the AISI (American Iron and Steel Institute). A stainless steel from the family of ferritic steels, preferably from the subfamily referred to as Type 430 whose UNS designation is S43000, for the part(s) of G3 connected to the 2 sintered glass bars, in which case the electrode G3 also includes a piece of a material which can delimit the electromagnetic field of the deflector, for example an "insert" piece of FN48. A stainless steel from the family of ferritic steels, preferably from the subfamily referred to as Type 430 whose UNS designation is S43000, for the cathode supports.

| | Selected | Expansible width between the glass bars | Tube startup, 6.3 V being applied | | | RF induction heating of the gun | | |
|---|---|---|---|---|---|---|---|---|
| | | | T° stabilized | Coefficient of expansion of the material | Expansion at startup (μm) | T° stabilized | Coeff. of expansion of the material | RF expansion (μm) |
| | material | mm | ° C. | $10^{-6}$/° C. | μm | ° C. | $10^{-6}$/° C. | μm |
| G4 et seq. | Inox 305 | 15 | 70 | 17 | 13 | 600 | 20 | 174 |
| G3 | Inox 430 | 15 | 80 | 10.5 | 9 | 790 | 11.5 | 133 |
| G2 | Inox 430 | 15 | 120 | 10.7 | 16 | 750 | 11.5 | 126 |
| G1 | Inox 430 | 15 | 180 | 11.0 | 26 | 680 | 11.5 | 114 |
| cathode supports | Inox 430 | 15 | 300 | 11 | 46 | 550 | 11 | 89 |

In the exemplary embodiments above, as regards the electrode G4, it is sufficient to use an inexpensive material such as a stainless steel either from the common family of austenitic steels or from the family of ferritic steels, such as the subfamily referred to as Type 430 whose UNS designation is S43000. In the case of an electron gun having more than four electrodes, such as that represented in FIG. 1, the electrodes G4 et seq. may be made of this material.

What is claimed is:

1. An electron gun, comprising:

at least three emissive cathodes supported by electrode supports, a first electrode (G1) and a second electrode (G2) for control and shaping of the electron beam emitted by the cathode, a third electrode (G3) for focusing or pre-focusing the electrons, and a fourth electrode (G4) for accelerating the electron beam, wherein the first, second and fourth electrodes are made of a non-oxidizing alloy whose coefficient of expansion between 20° C. and 300° C. lies between $4\times10^{-6}$/° C. and $13\times10^{-6}$/° C. and wherein the third electrode is made of FeNi whose coefficient of thermal expansion is smaller than the coefficient of thermal expansion of G1, G2, and G4.

2. The electron gun of claim 1 wherein the cathode supports (SK1) are made of a non-oxidizing alloy whose coefficient of expansion between 20° C. and 300° C. lies between $4\times^{10-6}$/° C. and $13\times10^{-6}$/° C. and the third electrode is made of FeNi.

3. The electron gun of claim 1 wherein the fourth electrode (G4) Is made of a stainless steel, either from the common family of austenitic steels or from the family of ferritic steels.

4. The electron gun of claim 1 wherein the third electrode G3 also includes a piece of FeNi material which can delimit the electromagnetic field of the deflector.

5. The electron gun of claim 1 wherein the non-oxidizing alloy has a coefficient of expansion between 20° C. and 300° C. of between $7\times10^{-6}$/° C. and $13\times10^{-6}$/° C.

* * * * *